US005385087A

United States Patent [19]

Yao

[11] Patent Number: 5,385,087

[45] Date of Patent: Jan. 31, 1995

[54] MECHANISM FOR BINDING NAILS

[76] Inventor: Chun-I Yao, 58, Ma Yuan West St., Taichung, Taiwan, Prov. of China

[21] Appl. No.: 246,729

[22] Filed: May 23, 1994

[51] Int. Cl.[6] ..... B65B 13/30

[52] U.S. Cl. ..... 100/9; 53/585

[58] Field of Search ..... 100/9; 53/585; 29/235; 206/805

[56] References Cited

U.S. PATENT DOCUMENTS

| | | | |
|---|---|---|---|
| 28,753 | 6/1860 | Hobe | 100/9 X |
| 2,236,936 | 4/1941 | Camp | 100/9 |
| 3,186,333 | 6/1965 | Hoffman et al. | 100/9 |
| 3,572,396 | 3/1971 | Hoffman et al. | 100/9 X |

FOREIGN PATENT DOCUMENTS

| | | | |
|---|---|---|---|
| 659074 | 6/1929 | France | 100/9 |
| 2-233315 | 9/1990 | Japan | 100/9 |

*Primary Examiner*—Stephen F. Gerrity

[57] ABSTRACT

A mechanism for binding nails includes a cutter for cutting a rubber tube into rubber bands. A sleeve has a number of blades coupled to one end. A hook is disposed below the cutter for hooking the rubber band and for moving the rubber band to the blades. A rod is slidably engaged in the sleeve for expanding the blades and the rubber band. The rod includes a magnetic device for attracting nails. A ring is disposed beside the blades and moved relative to the blades for moving the rubber band away from the blades so as to bind the nails automatically.

2 Claims, 4 Drawing Sheets

MECHANISM FOR BINDING NAILS

BACKGROUND OF THE INVENTION

1. Field of the Invention

The present invention relates to a mechanism, and more particularly to a mechanism for binding nails.

2. Description of the Prior Art

Typically, nails are manually packaged or bound together by a rubber band, as shown in FIG. 1, the nails can not be stably held in place for binding process such that the nails can not be easily bound together manually.

The present invention has arisen to mitigate and/or obviate the afore-described disadvantages of the conventional packaging or binding of nails.

SUMMARY OF THE INVENTION

The primary objective of the present invention is to provide a mechanism for binding nails.

In accordance with one aspect of the invention, there is provided a mechanism for binding nails comprising means for moving a rubber tube to be cut, means for cutting the rubber tube into a rubber band, hook means disposed below the cutting means for hooking the rubber band, a sleeve including a center bore and including one end having a plurality of blades pivotally coupled thereto, a rod slidably engaged in the sleeve, means for moving the rod toward the blades for expanding the blades, an electro-magnetic means disposed in the rod for attracting nails when the rod moves beyond the blades, means for moving the hook means toward the blades, the rubber band being engaged and expanded by the blades when the blades are expanded by the rod, a ring disposed beside the blades, means for moving the ring toward or away from the sleeve, the ring being moved away from the sleeve when the nails move within the ring for moving the rubber band away from the blades, the nails being automatically bound by the rubber band when the rubber band is pushed away from the blades by the ring.

The ring includes a plurality of lugs extended radially inward therefrom and each having a notch formed therein for engaging with the nail and for allowing the lugs to engage with the rubber band.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
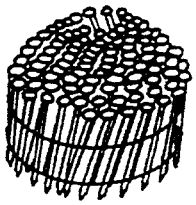
F I G. 1 PRIOR ART
FIG. 1 is a perspective view of a number of nails bound together.
Figure 2:
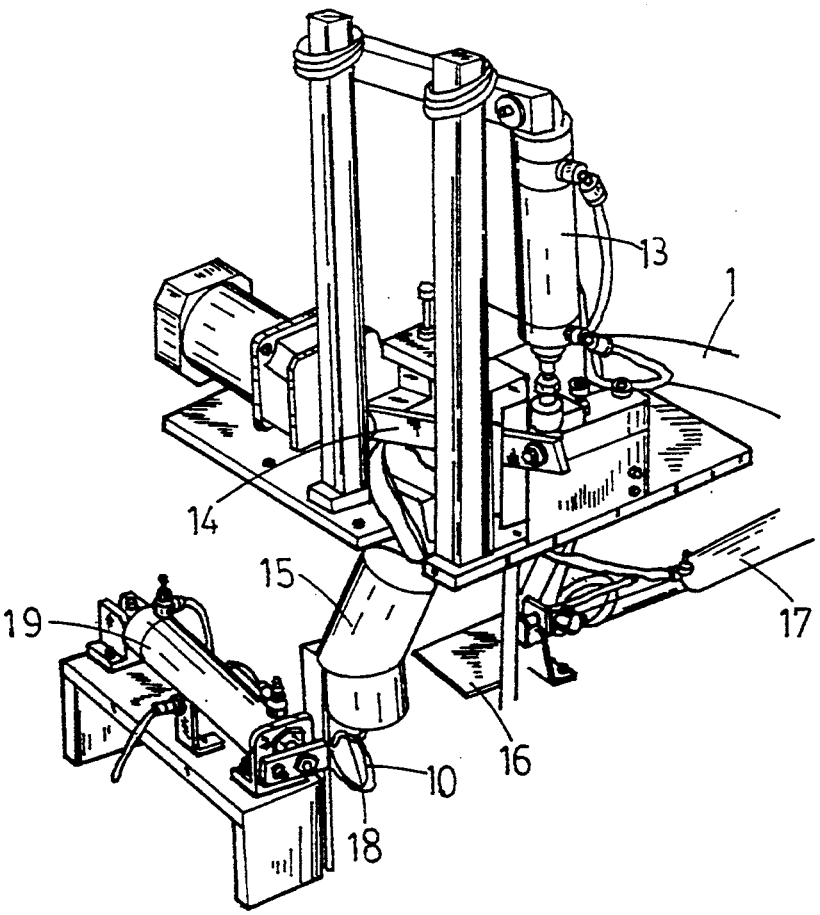
FIG. 2 is a perspective view of a mechanism for binding nails in accordance with the present invention.
Figure 3:
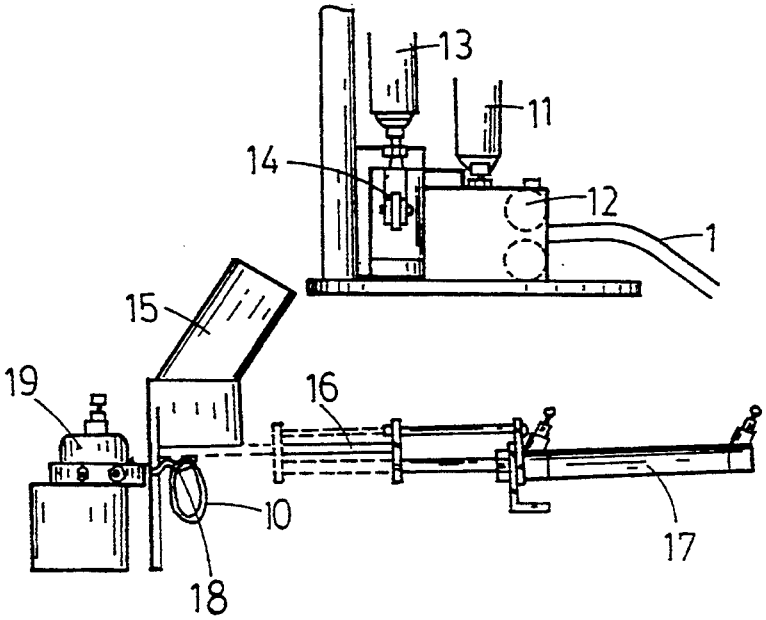
FIGS. 3 and 4 are plane views illustrating the operation of the mechanism.

Referring to the drawings, and initially to FIGS. 1 to 3, a mechanism for binding nails in accordance with the present invention comprises a rubber tube 1 moved and guided toward a cutter 14 by a pair of rollers 12 which are disposed in a block. An actuator 11 is connected to the block for moving the rollers 12 and for supplying the rubber tube 1 to the cutter 14. An actuator 13 is coupled to the cutter 14 for moving the cutter 14 in order to cut the rubber tube 1 into rubber bands 10. A guide 15 is disposed beside and below the cutter 14 for receiving the rubber bands. A plate 16 is disposed below the guide 15 and is connected to an actuator 17 which moves the plate 16 toward or away from the guide 15. The rubber band 10 received in the guide 15 and supported on the plate 16 will be dropped when the plate 16 is moved away from the guide 15 by the actuator 17. A hook 18 is secured to the piston rod 191 of an actuator 19 and is moved to the position right below the guide 15 for hooking the rubber band 10 dropped from the guide 15, best shown in FIG. 3.

Figure 5:
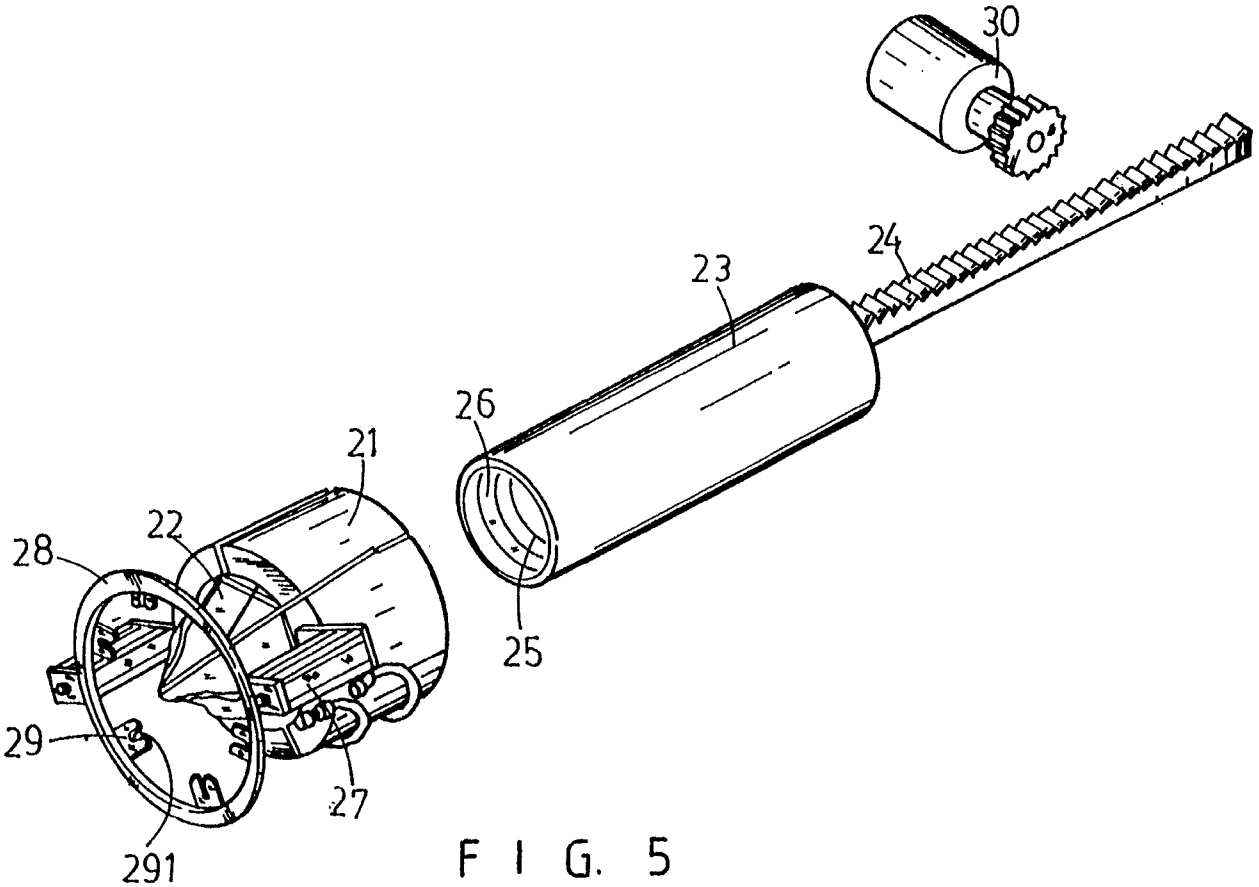
FIG. 5 is a partial exploded view of the mechanism.
Figure 6:
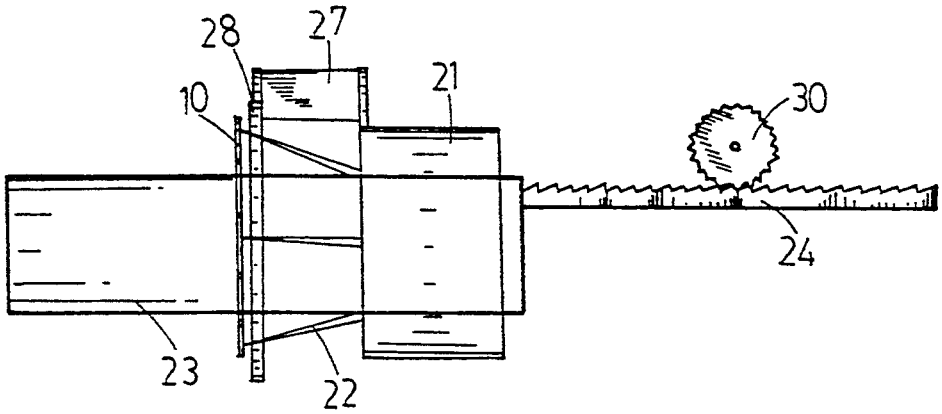
FIGS. 6 and 7 are schematic views illustrating the operation of the mechanism.
Figure 7:
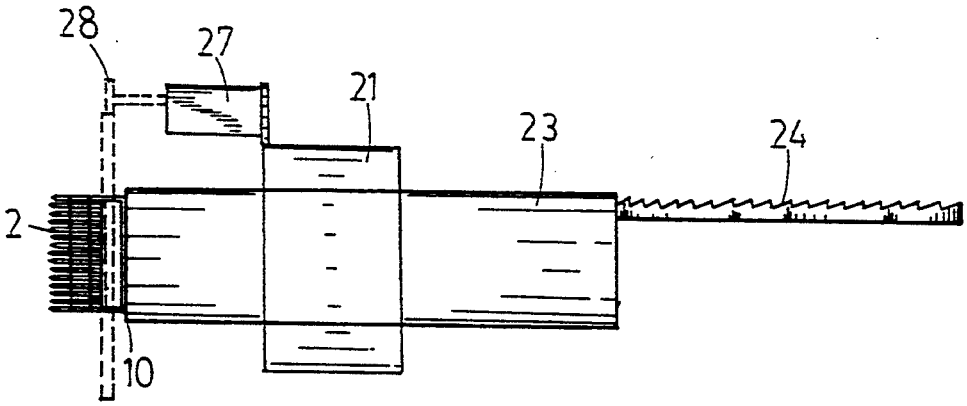

Referring next to FIGS. 5 to 7, the mechanism includes a sleeve 21 having a center bore and having a plurality of blades 22 pivotally disposed on one end for enclosing the center bore of the sleeve 21. A ring 28 is coupled to the sleeve 21 by two actuators 27 and includes a plurality of lugs 29 extended radially inward therefrom, a notch 291 is formed in each of the lugs 29. The number of lugs 29 corresponds to the number of blades 22. A rod 23 is engagable in the bore of the sleeve 21, a rack 24 is connected to the rod 23 and engaged with a pinion of a motor 30 such that the rod 23 can be moved inward or outward of the sleeve 21. The rod 23 includes a depression 25 formed in one end thereof distal to the rack 24 for receiving an electro-magnetic device 26.

Figure 4:
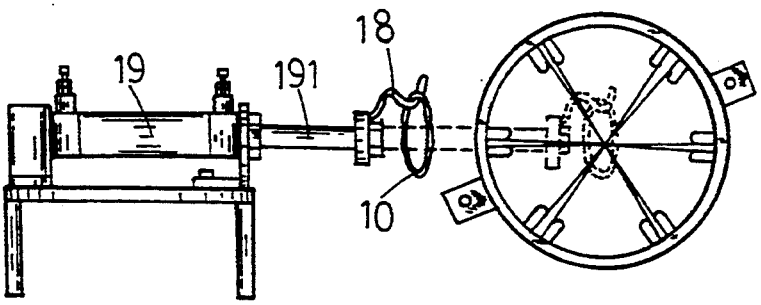

In operation, as shown in FIG. 4, the rubber band 10 is supplied to the free ends of the blades 22, the blades 22 are then expanded by the rod 23 when the rod 23 is moved inwards of the sleeve 21. The electro-magnetic device 26 is then actuated to attract nails 2, best shown in FIG. 7. When the free end of the rod 23 is aligned with the ring 28, the ring 28 is moved away from the sleeve 21 by the actuators 27 so as to move the rubber band away from the blades 22 with the lugs 29. The notches 291 may engage with the nails such that the lugs 29 may move the rubber band away from the blades 22. The electro-magnetic device 26 is deactivated when the nails are bound together by the rubber band. A conveyer may be disposed below the ring 28 for collecting the bound nails.

Accordingly, nails can be automatically bound together by the mechanism in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mechanism for binding nails comprising means for moving a rubber tube to be cut, means for cutting said rubber tube into a rubber band, hook means disposed below said cutting means for hooking said rubber band, a sleeve including a center bore and including one end having a plurality of blades pivotally coupled thereto, a rod slidably engaged in said center bore of said sleeve, means for moving said rod toward said blades for expanding said blades, an electro-magnetic means disposed in said rod for attracting nails when said rod moves beyond said blades, means for moving said hook means toward said blades for engaging said rubber band with said blades and for allowing expanding of said rubber band by said blades, a ring disposed beside said blades close to said blades, means for moving said ring toward or away from said blades for moving said rubber band away from said blades in order to bind said nails when said nails move within said ring.

2. A mechanism according to claim 1, wherein said ring includes a plurality of lugs extended radially inward therefrom and each having a notch formed therein for engaging with said nails and for allowing said lugs to engage with said rubber band.

* * * * *